US007281563B2

(12) United States Patent
Wu

(10) Patent No.: US 7,281,563 B2
(45) Date of Patent: Oct. 16, 2007

(54) VENETIAN BLIND WITH A CORD-WINDING DEVICE

(76) Inventor: Wen-Te Wu, No. 598, Lu-Tsao, Hsi-Ching Tsun, Lu-Tsao Hsiang, Chia-Yi Hsien (TW)

( * ) Notice: Subject to any disclaimer, the term of this patent is extended or adjusted under 35 U.S.C. 154(b) by 368 days.

(21) Appl. No.: 10/983,714

(22) Filed: Nov. 9, 2004

(65) Prior Publication Data

US 2006/0096719 A1 May 11, 2006

(51) Int. Cl.
*E06B 9/322* (2006.01)

(52) U.S. Cl. ..... 160/170; 160/173 R

(58) Field of Classification Search ..... 160/168.1 R, 160/176.1 R, 174 R, 170, 173 R; 242/397, 242/397.5, 615.2, 615.4, 548, 548.1
See application file for complete search history.

(56) References Cited

U.S. PATENT DOCUMENTS

| | | | | |
|---|---|---|---|---|
| 2,160,175 | A * | 5/1939 | Shakespeare, Jr. | 242/279 |
| 4,068,383 | A * | 1/1978 | Krebs | 33/767 |
| 4,194,703 | A * | 3/1980 | Roe | 242/381.3 |
| 5,133,399 | A * | 7/1992 | Hiller et al. | 160/171 |
| 5,139,213 | A * | 8/1992 | Furomoto | 242/279 |
| 5,482,100 | A | 1/1996 | Kuhar | |
| 6,062,292 | A * | 5/2000 | Bryant | 160/178.1 R |
| 6,474,394 | B2 * | 11/2002 | Kuhar | 160/170 |
| 7,104,492 | B1 * | 9/2006 | Massell et al. | 242/397 |
| 2002/0011315 | A1 * | 1/2002 | Ciuca et al. | 160/170 |
| 2004/0154758 | A1 * | 8/2004 | Cheng et al. | 160/170 |
| 2004/0188038 | A1 * | 9/2004 | Nien | 160/168.1 R |

* cited by examiner

*Primary Examiner*—Peter M. Cuomo
*Assistant Examiner*—Russell Bloodgood
(74) *Attorney, Agent, or Firm*—Finnegan, Henderson, Farabow, Garrett & Dunner, L.L.P.

(57) ABSTRACT

A venetian blind includes a covering unit, and a cord-winding device. The covering unit includes a plurality of slats and two lifting cords. The cord-winding device includes a casing fixed on the headrail, a plurality of spring-surrounding members disposed rotatably within the casing, a plurality of co-rotatable gears sleeved respectively and fixedly on the spring-surrounding members, and a spiral spring disposed within one of the spring-surrounding members. The spiral spring is disposed within one of the spring-surrounding members, and has two ends fastened respectively to the casing and the one of the spring-surrounding members. Each of the lifting cords has two ends connected respectively to the bottom rail and a corresponding one of the spring-surrounding members. The spiral spring imparts a spring force to substantially balance the total weight of the bottom rail and the covering unit so as to maintain the bottom rail at any position.

1 Claim, 7 Drawing Sheets

VENETIAN BLIND WITH A CORD-WINDING DEVICE

BACKGROUND OF THE INVENTION

1. Field of the Invention

This invention relates to a venetian blind, and more particularly to a venetian blind that includes a cord-winding device that imparts a spring force to balance the total weight of a bottom rail and a covering unit so as to maintain the bottom rail at any desired position.

2. Description of the Related Art

U.S. Pat. No. 5,482,100 discloses a cordless, balanced venetian blind or shade with a consistent variable force spring motor, which can maintain a bottom rail at any desired position by the balance between a spring force and the total weight of the bottom rail and a covering unit. The covering unit includes a plurality of parallel slats and two lifting cords. The venetian blind has the following disadvantages:

(1) A drum unit consisting of a storage drum and an output drum is provided for mounting of a spring. This increases the volume of the venetian blind.

(2) Two lifting cords are stored on a cord spool, and therefore do not move smoothly.

(3) When it is desired to increase the length of the covering unit, it is necessary to replace the spring with a new one possessing a higher coefficient of elasticity, or to mount one or more additional drum units on a back wall of a bracket, thereby resulting in difficulties in increasing the length of the covering unit.

SUMMARY OF THE INVENTION

The object of this invention is to provide a venetian blind, which is capable of overcoming the above-mentioned disadvantages associated with the prior art.

According to this invention, a venetian blind includes a headrail, a bottom rail, a covering unit, and a cord-winding device. The covering unit is disposed between the headrail and the bottom rail, and includes a plurality of slats, and at least two lifting cords each extending through the slats. Each of the lifting cords has a lower end fastened to the bottom rail, and an upper end. The cord-winding device includes a casing, a plurality of annular spring-surrounding members, a plurality of co-rotatable gears, and at least one spiral spring. The casing is fixed on the headrail. The spring-surrounding members are disposed rotatably within the casing. The upper ends of the lifting cords are fastened respectively to two of the spring-surrounding members. Each of the lifting cords has a portion wound on a corresponding one of the spring-surrounding members. The gears are sleeved respectively and fixedly on the spring-surrounding members. Each of the gears meshes with at least one of the rest of the gears so as to allow for synchronous rotation of the gears. The spiral spring is disposed within one of the spring-surrounding members, has two ends fastened respectively to the casing and the one of the spring-surrounding members, and imparts a spring force to substantially balance the total weight of the bottom rail and the covering unit so as to maintain the bottom rail at any desired position with respect to the headrail.

Each of the spring-surrounding members is relatively compact. Therefore, the total volume of the venetian blind is reduced.

The lifting cords are wound respectively on two corresponding ones of the spring-surrounding members so as to allow for smooth movement of the lifting cords.

When it is desired to increase the total spring force, one or more additional spiral springs can be mounted within the cord-winding device.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
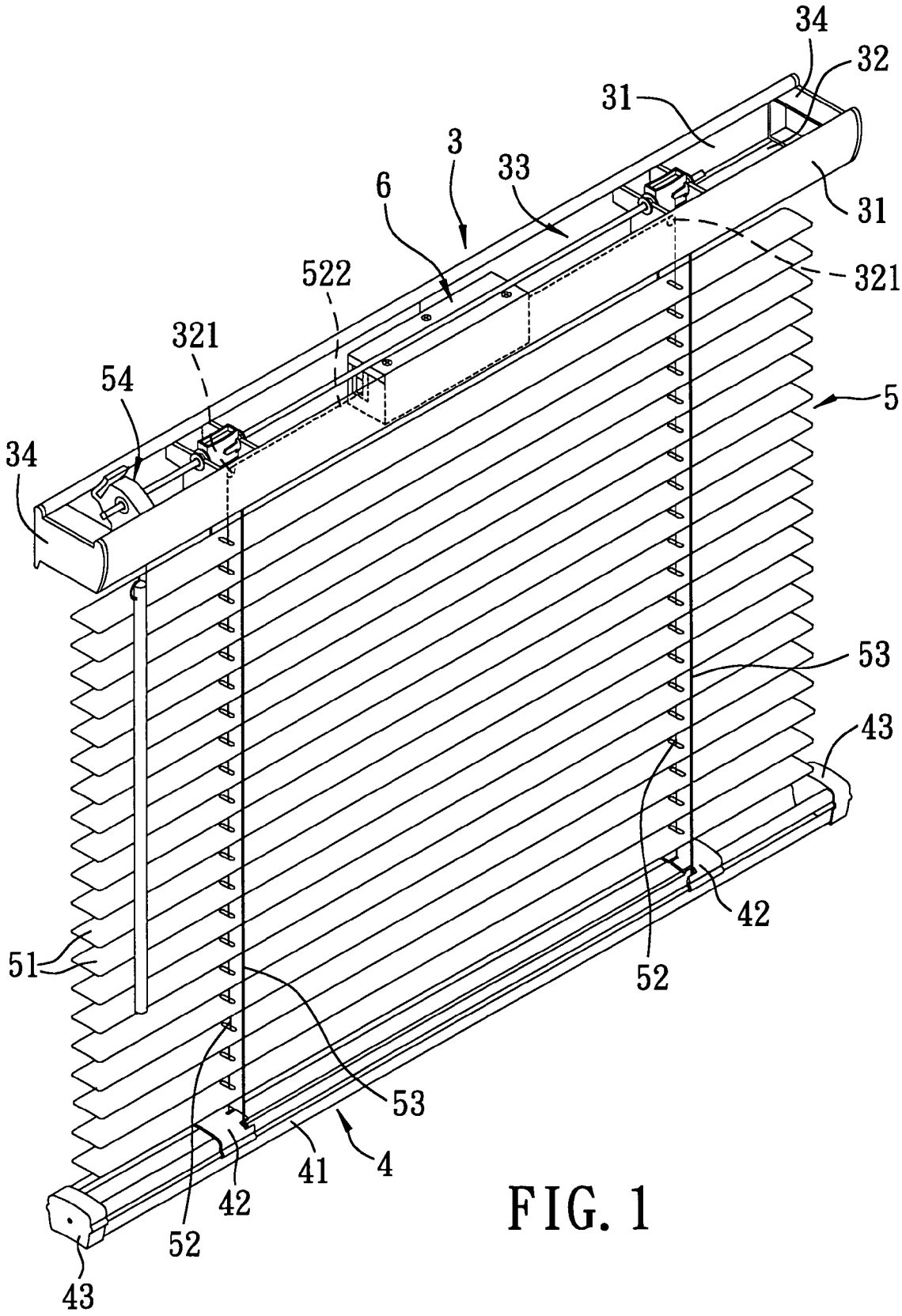
FIG. 1 is a perspective view of the first preferred embodiment of a venetian blind according to this invention.
Figure 2:
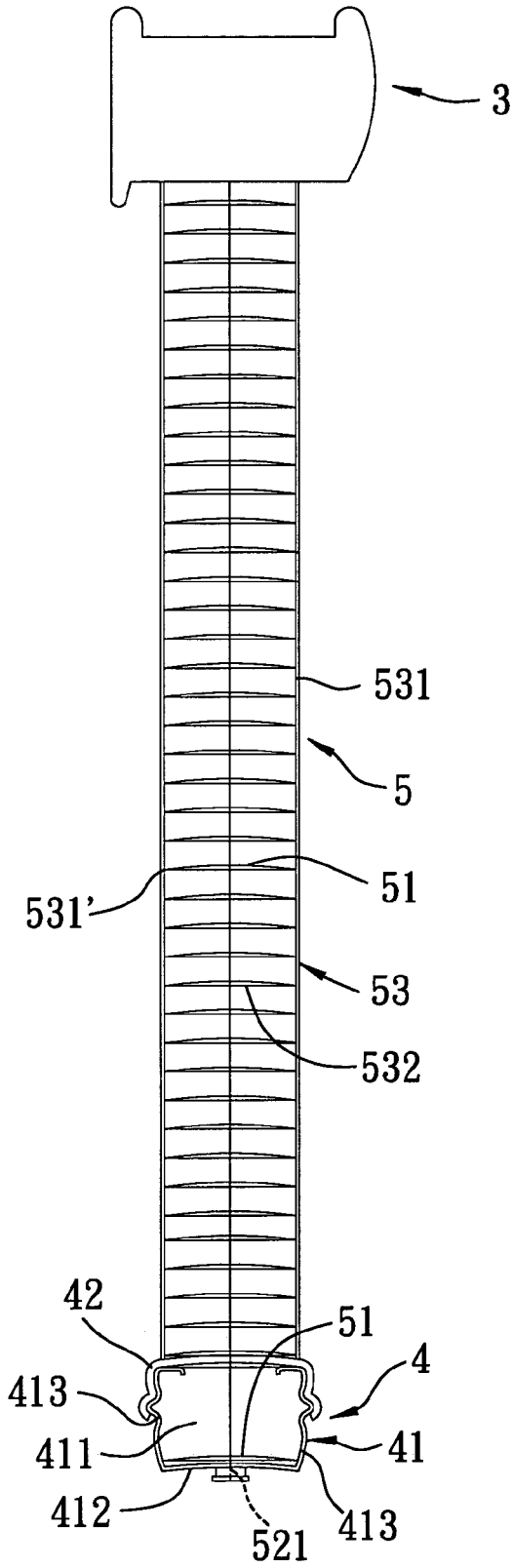
FIG. 2 is a side view of the first preferred embodiment.

Before the present invention is described in greater detail in connection with the preferred embodiments, it should be noted that similar elements and structures are designated by like reference numerals throughout the entire disclosure.

Referring to FIGS. 1, 2, 3, 4, and 5, the first preferred embodiment of a venetian blind according to this invention is shown to include a headrail 3, a bottom rail 4, a covering unit 5, and a cord-winding device 6.

The headrail 3 includes a pair of vertical front and rear walls 31, a horizontal bottomwall 32, an accommodating space 33 defined among the front and rear walls 31 and the bottom wall 32 and having two ends, and a pair of end pieces 34 press fitted respectively within the ends of the accommodating space 33. The front and rear walls 31 extend respectively, integrally, and upwardly from opposite front and rear sides of the bottom wall 32. The bottom wall 32 is formed with a pair of cord holes 321 therethrough.

Figure 3:
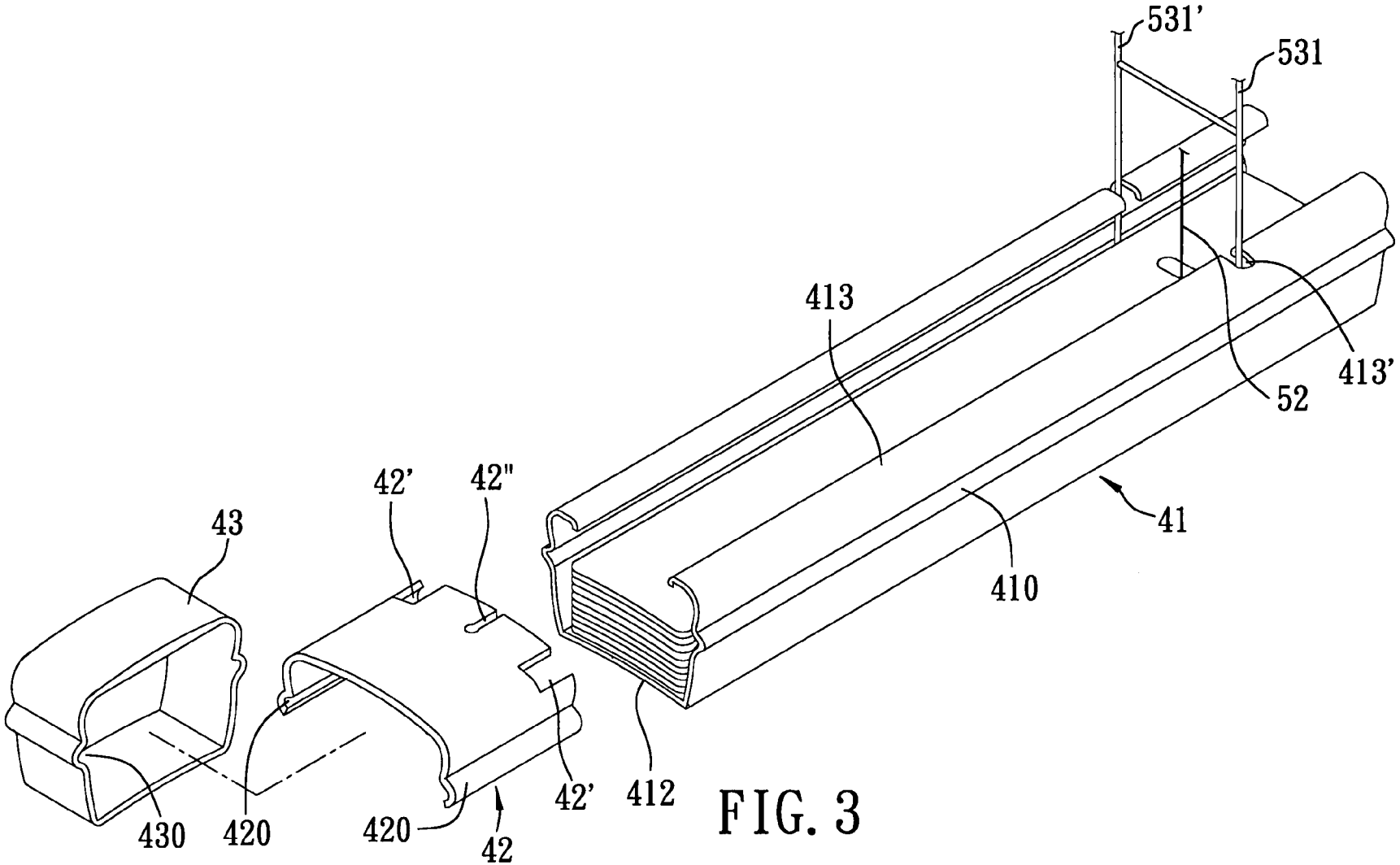
FIG. 3 is a fragmentary exploded perspective view of a bottom rail of the first preferred embodiment.
Figure 4:
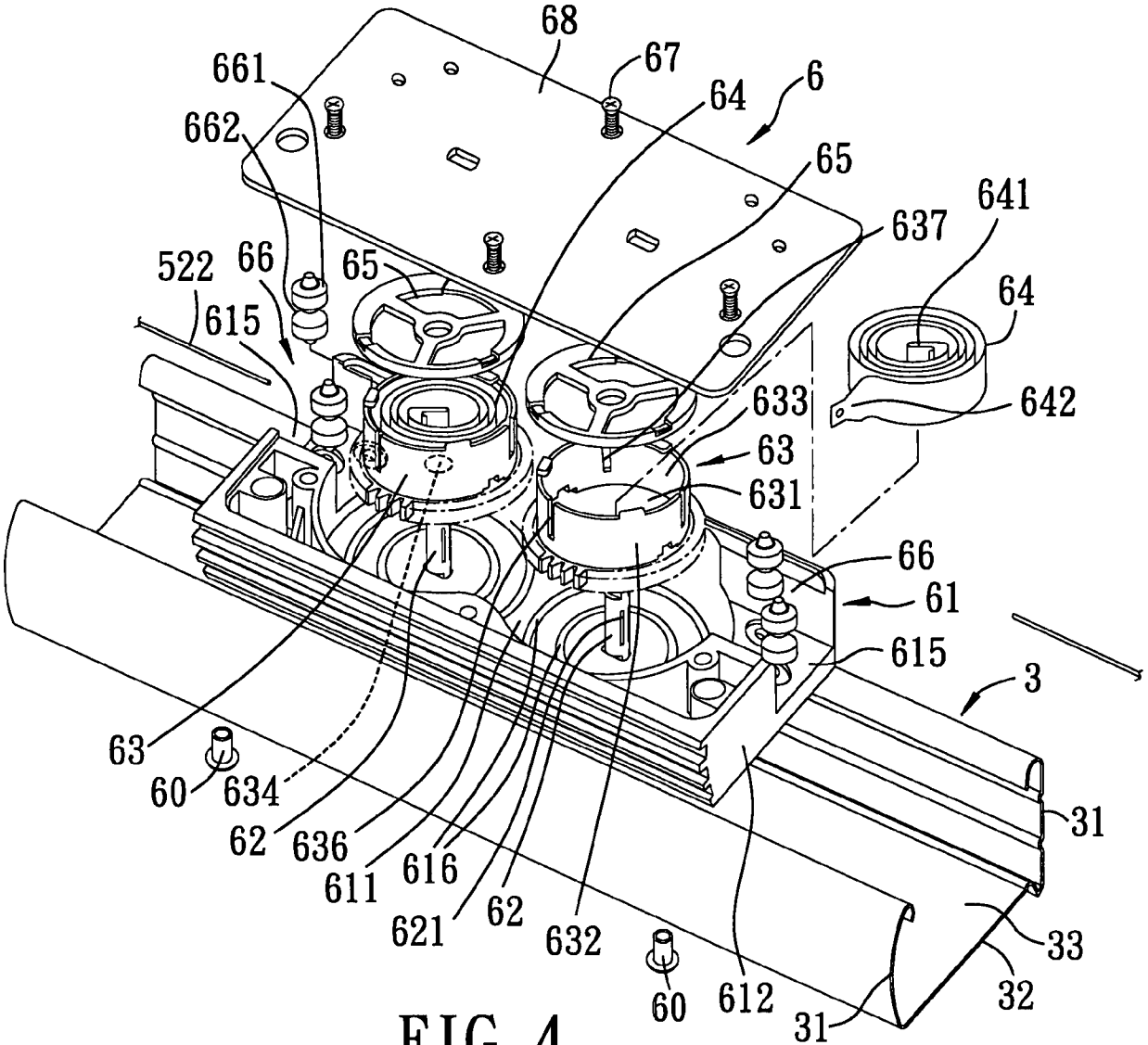
FIG. 4 is a partly exploded perspective view of a headrail and a cord-winding device of the first preferred embodiment.

The bottom rail 4 includes a hollow rail body 41, a pair of retainers 42, and two end caps 43 sleeved respectively on two opposite ends of the rail body 41 in a tight fitting manner. The rail body 41 is generally C-shaped to define a slat-accommodating groove 411 therein, and has a bottom wall 412, and a pair of front and rear walls 413 extending respectively and upwardly from front and rear sides of the bottom wall 412. Each of the front and rear walls 413 is formed with two upper end notches 413' (only one is shown in FIG. 3). Each wall 413 of the rail body 41 is formed with two opposed projections 410 extending away from each other. Each of the retainers 42 is formed with two side notches 42', a middle notch 42", and two hook ends 420 that engage respectively the projections 410 of the rail body 41 so as to retain the retainers 42 on an upper end of the rail body 41. Each of the end caps 43 is formed with two opposed grooves 430 that engage respectively the projections 410 of the rail body 41.

The covering unit 5 is disposed between the headrail 3 and the bottom rail 4, and includes a plurality of slats 51, a pair of lifting cords 52 each extending through the slats 51, a pair of ladder cords 53, and an angle-controlling unit 54. The length and width of each of the slats 51 are slightly smaller than those of the accommodating groove 411 in the rail body 41 of the bottom rail 4. Each of the lifting cords 52 has a lower end 521 extending between the front and rear walls 413 of the bottom rail 4 and through the middle notch 42" in the corresponding retainer 42 and fastened to the bottom wall 412 of the bottom rail 4, and an upper end 522 extending into the accommodating space 33 in the headrail 3 through the corresponding cord hole 321 in the headrail 3. Each of the ladder cords 53 has a vertical front cord portion 531 disposed in front of the slats 51, a vertical rear cord portion 531' disposed behind the slats 51, and a slat-supporting cord portion 532. The front and rear cord portions 531, 531' extend respectively through the side notches 42' in the retainers 42 and the upper end notches 413' in the bottom rail 4. Each of the slat-supporting cord portions 532 has front and rear ends connected respectively and fixedly to the front and rear cord portions 531, 531' of the corresponding ladder cord 53. The angle-controlling unit 54 is connected to the covering unit 5 in a known manner, and is operable to adjust the inclination angle of the slats 51 in corporation with the ladder cords 53 also in a known manner. When the retainers 42 are removed from the rail body 41, the lowermost ones of the slats 51 can be moved into the slat-accommodating groove 411 in the bottom rail 4 so as to reduce the total length of the covering unit 5. Thereafter, the retainers 42 can be again mounted to the rail body 41 so as to prevent removal of the lowermost slats 51 from the slat-accommodating groove 411.

The cord-winding device 6 includes a casing 61, two projecting posts 62, two annular spring-surrounding members 63, two spiral springs 64, two cover plates 65, two guiding roller units 66, and a casing cover 68 connected fixedly to the casing 61 by a plurality of bolts 67.

The casing 61 is mounted fixedly to the bottom wall 32 of the headrail 3 by two rivets 60. Alternatively, the casing 61 may be attached removably to the casing 3 by bolts. The casing 61 includes a bottom wall 611, a surrounding wall unit 612 extending integrally and upwardly from an outer peripheral portion of the bottom wall 611, two notches 615 formed in the surrounding wall unit 612 and aligned along a longitudinal direction of the headrail 3, and two projecting ring units. Each of the projecting ring units includes two concentric rings 616 projecting integrally and upwardly from the bottom wall 611. The upper ends 522 of the lifting cords 52 extend respectively through the notches 615 in the casing 61.

The projecting posts 62 are fixed respectively on and extend upwardly from the bottom wall 611 of the casing 61. Alternatively, the projecting posts 62 may be formed integrally with the bottom wall 611 of the casing 61.

Figure 5:
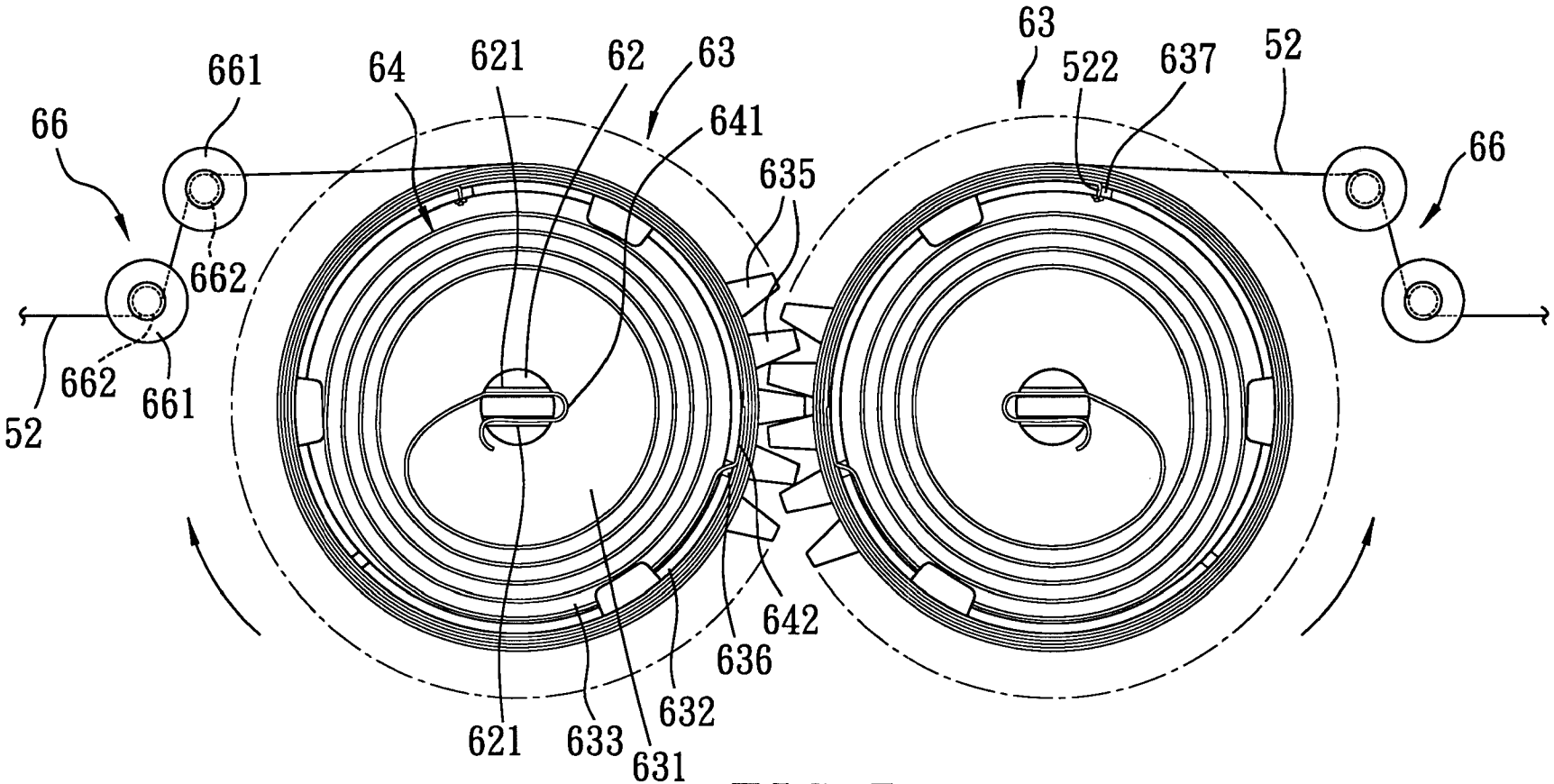
FIG. 5 is a schematic fragmentary top view of the first preferred embodiment, illustrating connection between the cord-winding device and two lifting cords.

The spring-surrounding members 63 are sleeved rotatably on the projecting posts 62, and are disposed respectively and rotatably on the projecting ring units. Each of the spring-surrounding members 63 is confined between two concentric rings 616 of the casing 61, and has a circular bottom wall 631 abutting against the bottom wall 611 of the casing 61, a surrounding wall 632 extending upwardly from an outer peripheral portion of the bottom wall 631 to define a spring-accommodating chamber 633 therein, a central hole 634 formed at the center of the bottom wall 631 for extension of the corresponding projecting post 62 therethrough, a gear 635 sleeved fixedly on the bottom wall 631, a spring retaining groove 636 formed in the surrounding wall 632, and a cord retaining groove 637 formed in the surrounding wall 632. The upper ends 522 of the lifting cords 52 extend respectively through the cord retaining grooves 637 in the spring-surrounding members 63, and are respectively fastened to the spring-surrounding members 63, as shown in FIG. 5. Each of the lifting cords 52 has a portion wound on the corresponding spring-surrounding member 63, as shown in FIG. 5. The gears 635 mesh with each other so as to allow for synchronous rotation of the spring-surrounding members 63. Each of the gears 635 is rotatable about a vertical central axis thereof.

The spiral springs 64 are disposed within the casing 61. Each of springs 64 has a fixed end 641 extending through and secured within two retaining grooves 621 in the corresponding projecting post 62, and a rotatable end 642 extending through and secured within the spring retaining groove 636 in the corresponding spring-surrounding member 63. The spiral springs 64 have a predetermined coefficient of elasticity, and therefore can impart a spring force to substantially balance the total weight of the bottom rail 4 and the covering unit 5. As such, the bottom rail 4 can be maintained at any desired position with respect to the headrail 3.

The cover plates 65 are attached respectively to upper ends of the spring-surrounding members 63 so as to prevent removal of the springs 64 from the spring-retaining members 63.

The guiding roller units 66 are disposed in proximity to the notches 615. Each of the guiding roller units 66 includes two guiding rollers 661. Each of the guiding rollers 661 (see FIG. 5) is disposed rotatably on the casing 61, and has an annular outer surface that is formed with an annular groove 662 (see FIG. 5) for positioning of the corresponding lifting cord 52 therein.

When the bottom rail 4 is pushed upwardly by a desired distance, because a downward pulling force exerted on the lower ends 521 of the lifting cords 52 is reduced, the springs 64 rotate the spring-surrounding members 64 in directions indicated by the arrows in FIG. 5 so as to tauten the lifting cords 52. Subsequently, when the bottom rail 4 is released, balance between the total spring force of the springs 64 and the total weight of the bottom rail 4 and the covering unit 5 is achieved so as to stop vertical movement of the bottom rail 4. As such, the length of the covering unit 5 can be reduced.

When the bottom rail 4 is pulled downwardly, because the downward pulling force exerted on the lower ends 521 of the lifting cords 52 is increased, the lifting cords 52 are unwound respectively from the spring-surrounding members 63. Subsequently, when the bottom rail 4 is released, balance between the total spring force of the springs 64 and the total weight of the bottom rail 4 and the covering unit 5 is again achieved so as to stop vertical movement of the bottom rail 4. As such, the length of the covering unit 5 can be increased.

When the number of the slats 51 is reduced, because the total weight of the bottom rail 4 and the covering unit 5 is also reduced, one of the springs 64 can be removed from the corresponding spring-surrounding member 63.

Figure 6:
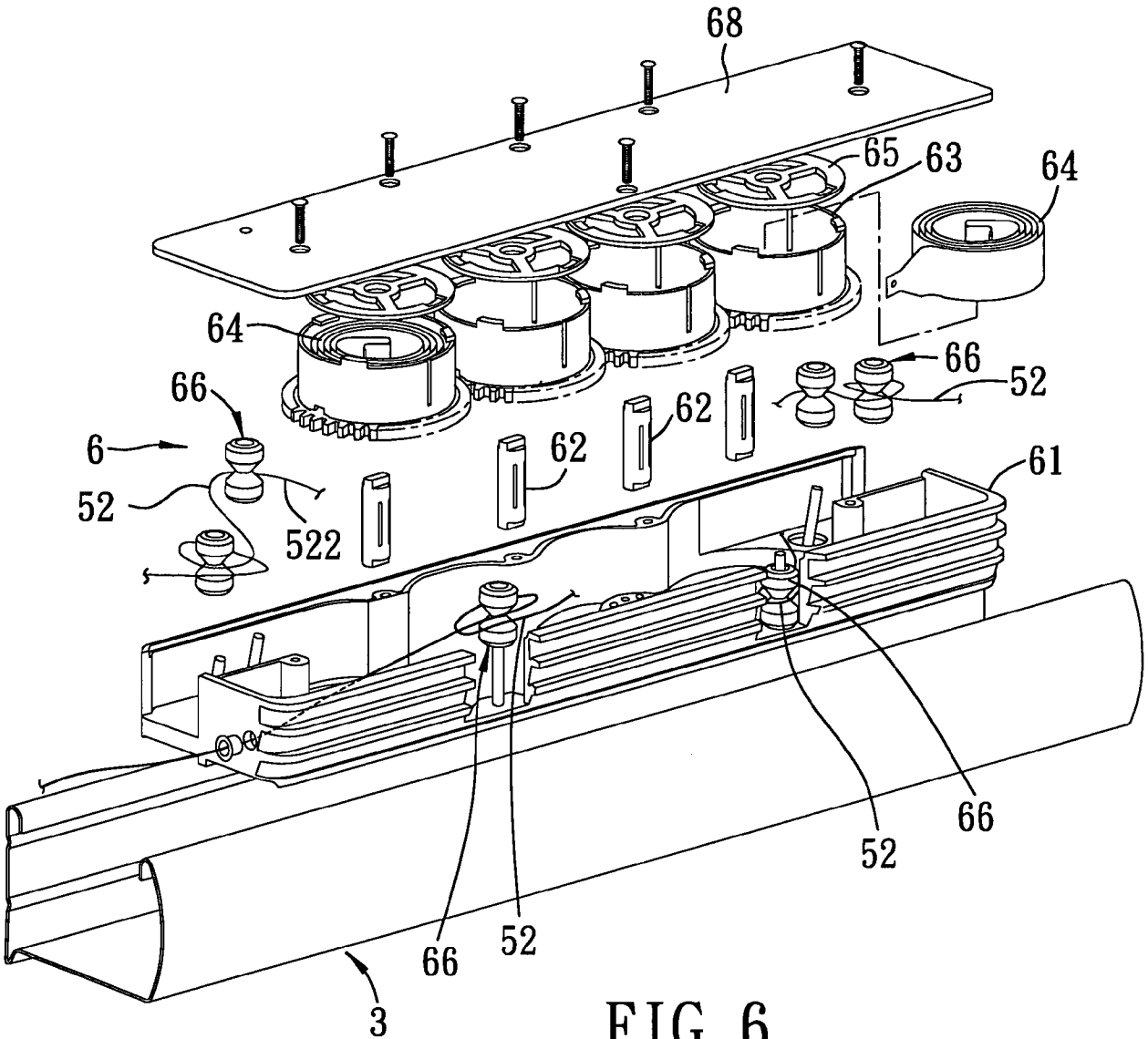
FIG. 6 is a partly exploded perspective view of a headrail and a cord-winding device of the second preferred embodiment of a venetian blind according to this invention.

FIG. 6 shows the second preferred embodiment of a venetian blind according to this invention, which is similar in construction to the first preferred embodiment except that this embodiment includes four lifting cords 52, four projecting ring units, four projecting posts 62, four spring-surrounding members 63, and four guiding roller units 66. In some cases, one, two, or three of the springs 64 can be removed to achieve the balance between the total spring force and the total weight of the bottom rail 4 and the covering unit 5.

Figure 7:
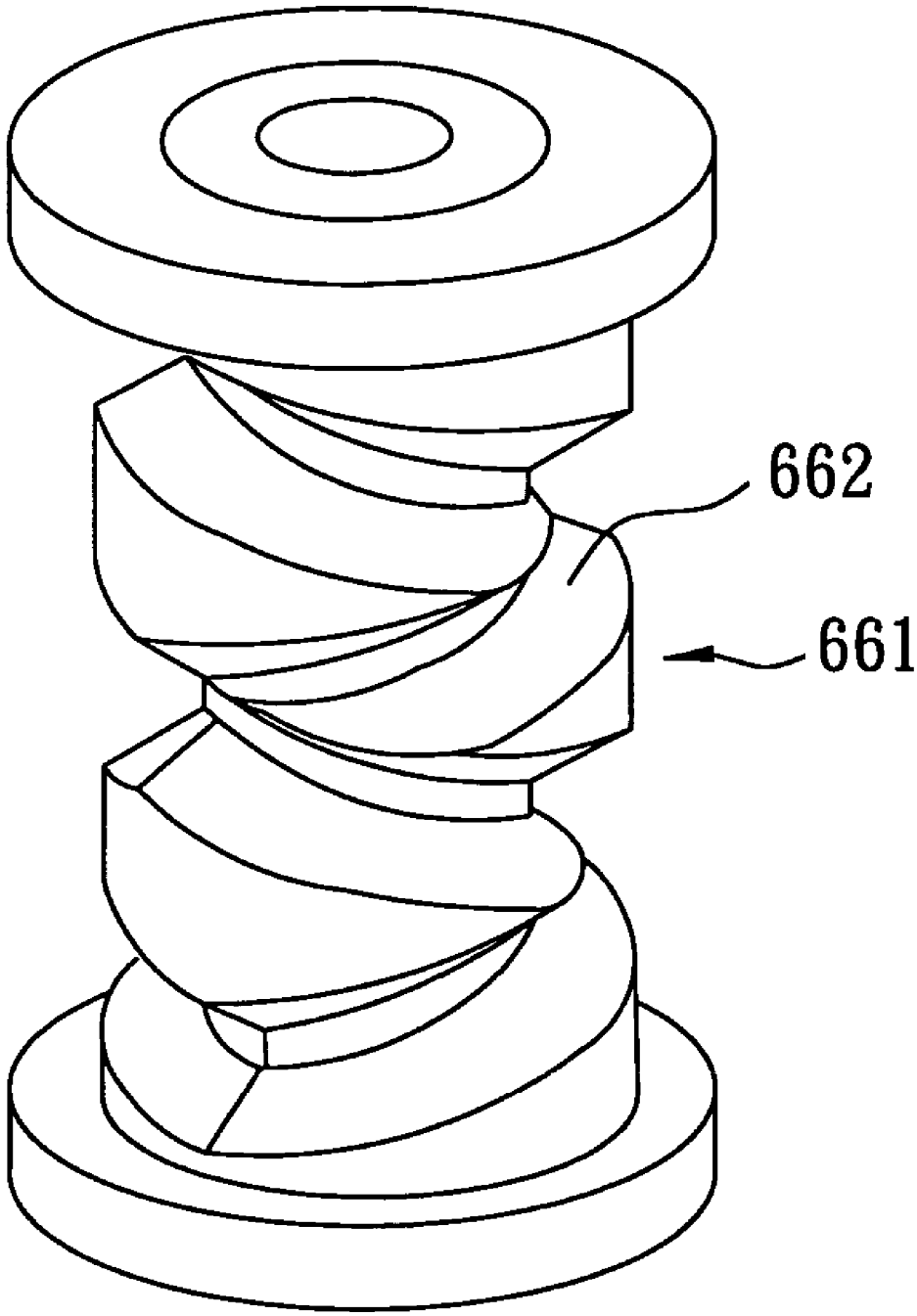
FIG. 7 is a perspective view of a modified guiding roller.

FIG. 7 shows a modified guiding roller 661. The modified guiding roller 661 has an annular outer surface that is formed with a helical groove 662, within which the corresponding lifting cord 52 extends.

Some of the advantages of this invention can be summarized as follows:

(1) The cord-winding device 6 is relatively compact. Thus, the total volume of the venetian blind is reduced.

(2) The lifting cords 52 are wound respectively on the corresponding ones of the spring-surrounding members 63 so as to allow for smooth movement of the lifting cords 52.

(3) The total spring force of the springs 64 can be adjusted by changing the number of the springs 64 mounted in the spring-surrounding members 63.

(4) The length of the covering unit 5 can be reduced by placing the lowermost ones of the slats 51 into the bottom rail 4.

With this invention thus explained, it is apparent that numerous modifications and variations can be made without departing from the scope and spirit of this invention. It is therefore intended that this invention be limited only as indicated by the appended claims.

I claim:

1. A venetian blind comprising:

a headrail;

a bottom rail;

a covering unit disposed between said headrail and said bottom rail and including a plurality of slats, and at least two lifting cords each extending through said slats, each of said lifting cords having a lower end fastened to said bottom rail, and an upper end; and a cord-winding device including a casing fixed on said headrail, a plurality of annular spring-surrounding members disposed rotatably within said casing, said upper ends of said lifting cords being fastened respectively to two of said spring-surrounding members, each of said lifting cords having a portion wound on a corresponding one of said spring-surrounding members, a plurality of co-rotatable gears sleeved respectively and fixedly on said spring-surrounding members, each of said gears meshing with at least one of the rest of said gears so as to allow for synchronous rotation of said gears, and at least one spiral spring disposed within one of said spring-surrounding members and having two ends fastened respectively to said casing and said one of said spring-surrounding members, said spiral spring imparting a spring force to substantially balance the total weight of said bottom rail and said covering unit so as to maintain said bottom rail at any position with respect to said headrail, wherein said cord-winding device further includes a plurality of guiding roller units, each of which includes at least one guiding roller, said guiding roller being disposed rotatably on said casing, said lifting cords extending respectively around two corresponding ones of said guiding rollers, and wherein said guiding roller of each of said guiding roller units has an annular outer surface that is formed with a helical groove, within which a corresponding one of said lifting cords extends.

* * * * *